United States Patent [19]

Leffler et al.

[11] 4,359,950

[45] Nov. 23, 1982

[54] METHOD FOR MAXIMIZING THE REDUCTION EFFICIENCY OF A RECOVERY BOILER

[75] Inventors: Nils Leffler, London, England; Kalevi Kaski, Klaukkala, Finland

[73] Assignee: Measurex Corporation, Cupertino, Calif.

[21] Appl. No.: 193,554

[22] Filed: Oct. 3, 1980

[51] Int. Cl.[3] ..... F23N 5/18

[52] U.S. Cl. ..... 110/188; 162/30.1; 236/15 E; 422/185; 431/76

[58] Field of Search ..... 110/188; 236/15 E; 431/76, 12; 422/111, 185; 162/30.1

[56] References Cited

U.S. PATENT DOCUMENTS

| | | | |
|---|---|---|---|
| 3,607,117 | 9/1971 | Shaw et al. | 236/15 E X |
| 3,644,092 | 2/1972 | Campbell | 236/15 E |
| 3,723,047 | 3/1973 | de Livois | 236/15 E X |
| 3,877,879 | 4/1975 | Palm et al. | 431/76 X |
| 4,235,171 | 11/1980 | Leonard | 236/15 E X |

FOREIGN PATENT DOCUMENTS

| | | | |
|---|---|---|---|
| 54-10437 | 1/1979 | Japan | 236/15 E |

*Primary Examiner*—Edward G. Favors

*Attorney, Agent, or Firm*—Ronald L. Yin; Hal J. Bohner

[57] ABSTRACT

In a recovery boiler having a plurality of air inputs, with the primary air input closest to the bed of the boiler, a fuel input, a smelt output, and an exhaust output, a method of controlling the combustion of fuel in the boiler to operate at the maximum reduction efficiency. The method includes the steps of measuring the amount of sulphur dioxide at the exhaust output; and varying the amount of air entering into the boiler through the primary air input until the minimum amount of sulphur dioxide is measured at the exhaust output.

12 Claims, 2 Drawing Figures

METHOD FOR MAXIMIZING THE REDUCTION EFFICIENCY OF A RECOVERY BOILER

BACKGROUND OF THE INVENTION

The present invention relates to a method for controlling the combustion of fuel in a recovery boiler, and more particularly, to a method for maximizing the reduction efficiency of said combustion.

A recovery boiler is a furnace wherein a waste fuel and air are combusted and chemicals from the waste fuel is recovered. In the pulp and paper industry one such waste fuel is called black liquor, which comprises in part water and sodium sulfate ($Na_2SO_4$). The combustion of black liquor in a recovery boiler results among others in a chemical process in which sodium sulfide ($Na_2S$) is recovered through the chemical reaction of the combustion process. In the pulp and paper industry, the recovery of sodium sulfide is essential to the paper manufacturer, inasmuch as the chemical is used in the chemical reaction to break the lignin of the fibers to produce pulp. For the pulp and paper industry then, the recovery boiler serves two functions, viz. an essential chemical of the paper producing process is produced from the recovery boiler, and a certain amount of energy is liberated for use to generate steam and/or electricity for use at the mill.

A recovery boiler comprises a fuel input, and a plurality of air inputs, a smelt output and an exhaust output. The air input, which is closest to the bed of the boiler in which air enters into the recovery boiler, is termed the primary air input. In the sequence of order of location of other air inputs into the boiler, the other air inputs into the boiler which are in successive further distance away from the bed are termed secondary air inputs and tertiary air inputs respectively. Fuel and air are primarily combusted in a zone which is located near the level of the secondary air input, and referred to as the oxidation zone. It has long been recognized that the primary air input is responsible for controlling the amount of air entering into the area just above the bed of the boiler, hence for creating either a reducing atmosphere or an oxidizing atmosphere in the area just above the bed of the boiler (a reducing atmosphere being defined as an oxygen starved atmosphere, whereas an oxidizing atmosphere is defined as an oxygen enriched atmosphere). The combustion of black liquor in a recovery boiler in a reducing atmosphere results in the following main chemical reaction:

$$2C + Na_2SO_4 \rightarrow 2CO_2 + Na_2S$$

The molten state of sodium sulfide ($Na_2S$) which is recovered from the bed of the boiler is termed smelt. It has been recognized that for this chemical reaction to take place, a reducing atmosphere should be maintained in the area just above the bed, hereafter referred to as the reduction zone. If there is too much primary air above the bed, then the reduction efficiency is decreased since an oxidation reaction instead of a reduction reaction will take place. Moreover, the heat released by the oxidation (combustion process) will primarily be used to raise the temperature of the excess amount of primary air. The raising of the temperature of the excess amount of primary air will cause a large upward draft of air. The upward draft will cause the liquor droplets to be retained longer before hitting the bed. The longer the liquor droplets remain in its flight, the more water in the liquor will evaporate and the combustion process will have to proceed further prior to the liquor droplets hitting the smelt bed. These effects will result in a gradually cooling surface temperature of the bed leading toward an eventual extinction of the fire. However, on the other hand, if too little primary air is supplied, the combustion process will not proceed causing the temperature in the smelt to decrease making it difficult to drain. The bed will then start building up, increasing the rate of cooling and rapidly extinguishing the fire. Hence, a very critical measure of the performance of this zone is the temperature above the bed.

Heretofore, one method of measuring the temperature above the bed is to take a direct measurement of the temperature of the bed through an optical pyrometer. While this direct approach is in theory the best, practical implementation of this approach has led to many difficulties due in part to (1) the temperature of the bed which is at an extremely high temperature, typically on the order of one thousand degrees centigrade (1000° C.) necessitating cooling means for the pyrometer; and (2) the dirty environment in which the pyrometer must operate and thus, it is subject to reliability problems.

SUMMARY OF THE INVENTION

In a method for controlling the combustion of fuel in a recovery boiler to operate at the maximum reduction efficiency, the method comprises measuring the amount of sulphur dioxide at the exhaust output and varying the amount of air entering into the boiler through the primary air input until the minimum amount of sulphur dioxide is measured at the exhaust output.

DETAILED DESCRIPTION OF THE INVENTION

Figure 1:
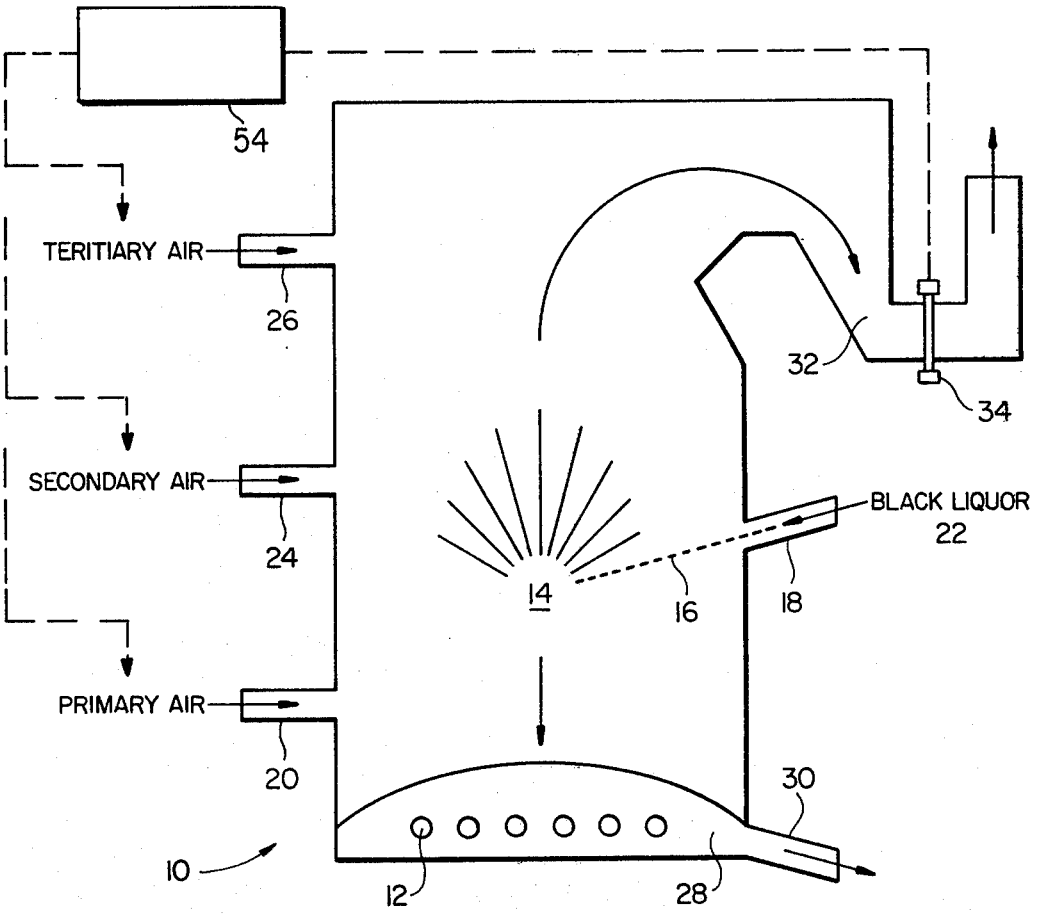
FIG. 1 is a schematic side view of a recovery boiler with an apparatus to measure the amount of sulphur dioxide at the exhaust output.

Referring to FIG. 1, there is shown a schematic side view of a recovery boiler 10. The recovery boiler 10 comprises a bed 12 over which a combustion zone 14 is located. Black liquor 22 enters into the boiler 10 through the fuel input 18. The liquor 22 is typically sprayed into the combustion zone 14 in the form of droplets 16 (greatly exaggerated). A plurality of air inputs are supplied to the boiler 10. A primary air input 20 supplies air to the boiler 10 which is closest to the bed 12. Secondary air input 24 and tertiary air input 26 supply air into the boiler 10 at further distances from the bed 12. The combustion of black liquor 22 and air in the combustion zone 14 creates the smelt 28 which is the molten state of the recovered chemical. The smelt 28 is drained from the boiler 10 via drain 30. In the recovery boiler 10, black liquor 22 is combusted with air from the primary air input 20 in combustion zone 14, which is limited to a reduction zone. As the exhaust by-product of the combustion is released from the combustion zone 14, air from the secondary air input 24 and tertiary air input 26 further aid the combustion process to create an oxidizing atmosphere, leading to an eventual exhaust of the by-products of the combustion through an exhaust output 32. At the exhaust output 32 of the boiler 10 a sensor 34, capable of detecting the amount of sulphur dioxide in the by-product of the combustion process, is located. Such a sensor 34 can utilize the principal of electro-magnetic radiation and absorption, as disclosed in U.S. Pat. No. 3,819,945. The sensor 34 is also capable of detecting the amount of carbon monoxide in the exhaust output 32.

Figure 2:
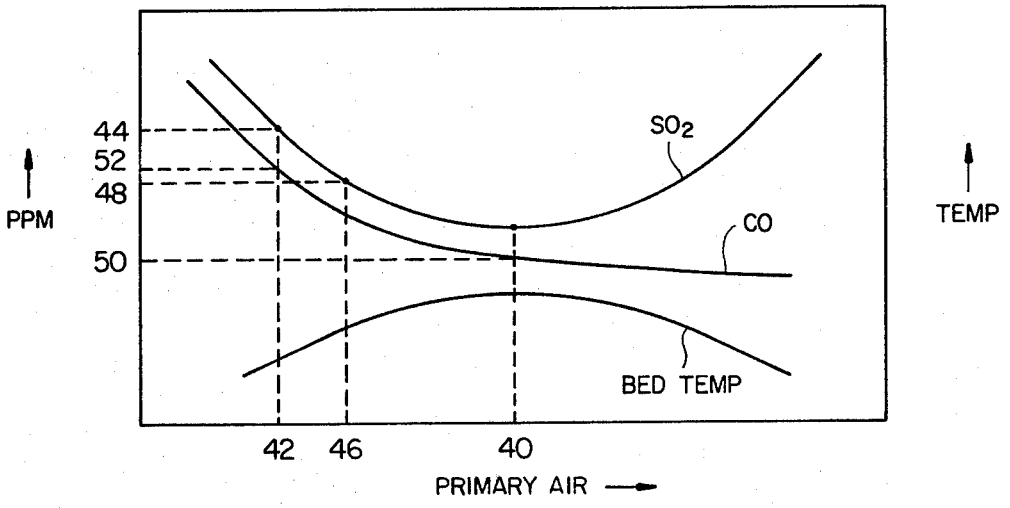
FIG. 2 is a graph of the amount of sulphur dioxide, carbon monoxide, and the temperature of the bed as a function of the amount of air flowing through the primary air input, with other air flows constant.

Referring to FIG. 2, there is shown a graph of the amount of air entering through the primary air input 20 as a function of the temperature of the bed 12 and as a function of the amount of sulphur dioxide ($SO_2$) detected at the exhaust output 32 by the sensor 34, and the amount of carbon monoxide (CO) detected by a sensor 34 located at the exhaust output 32 assuming that the air flow in the other air inputs is at a constant. FIG. 2 shows that there is a minimum amount of $SO_2$ detected as a function of the amount of air entering through the primary air input 20, with such minimal point 40 corresponding to the maximum temperature of the bed 12. The essence of the present embodiment of applicants' invention is that with a certain amount of air entering through the primary air input 20 such that the minimum amount of $SO_2$ is detected, the maximum temperature of bed 12 will be reached and the boiler will be operating at maximum reduction efficiency. Therefore, in the method of the present invention, to operate the recovery boiler 10 at maximum reduction efficiency, the amount of sulphur dioxide at the exhaust output 32 is measured, then the amount of air entering into the boiler through the primary air input 20 is varied until the minimum amount of sulphur dioxide is measured at the exhaust output 32.

In a further variation of the method of the present invention, the amount of sulphur dioxide at the exhaust output 32 is measured. This is shown, for example, as point 44, which corresponds to the amount of primary air 42. The amount of air entering through the primary air input 20 is increased to, for example, the amount represented by point 46. The amount of sulphur dioxide is noted or is measured again at the exhaust output 32. In the example shown in FIG. 2 this corresponds to point 48. The amount of air entering through the primary air input 20 is changed in response to the amount of sulphur dioxide initially measured, and the amount of sulphur dioxide noted (the later measured value of sulphur dioxide). In the event the amount of sulphur dioxide noted is less than the amount of sulphur dioxide measured (as shown by the example in FIG. 2, i.e., point 48 is less than point 44), the amount of air entering through the primary air input 20 in increased. On the other hand, in the event the amount of sulphur dioxide noted (the later measured value) is greater than the amount of sulphur dioxide initially measured, then the amount of air entering through the primary air input 20 is decreased.

In another variation of the method of the present invention, the amount of sulphur dioxide at the exhaust output 32 is initially measured. Subsequently, the amount of air entering through the primary air input 20 is decreased, as shown for example by the decrease of the air from point 46 to point 42. The amount of sulphur dioxide at the exhaust output 32 is then measured again (or is noted). The amount of air entering through the primary air input 20 is changed in response to the difference between the amount of sulphur dioxide initially measured and the amount of sulphur dioxide noted (later measured value). The amount of air entering through the primary air input 20 is increased if the amount of sulphur dioxide in the later measured value (noted value) is greater than the amount of sulphur dioxide first measured. Conversely, the amount of air entering through the primary air input 20 is decreased if the amount of sulphur dioxide noted is less than the amount of sulphur dioxide initially measured.

In yet another variation of the method of the present invention, the amount of carbon monoxide and the amount of sulphur dioxide are measured by the sensor 34 and are used to control the boiler 10 to operate at the maximum reduction efficiency and at the maximum combustion efficiency. In this method, a targe value for the amount of carbon monoxide, which corresponds to the maximum combustion efficiency of the boiler 10, must be a priori known. This may be set, for example, by the operator of the boiler 10. This is shown, for example, as point 50 in FIG. 2. In this above described method, the amount of carbon monoxide is detected by the sensor 34 at the exhaust output 32. The total amount of air entering into the boiler 10 through all the air inputs 20, 24 and 26 is changed until the amount of carbon monoxide detected by the sensor 34 is equal to the target value. The amount of sulphur dioxide is measured by the sensor 34. The amount of air entering into the boiler 10 through the primary air 20 is changed, but keeping the total amount of air entering into said boiler 10 at a constant, until the minimum amount of sulphur dioxide is measured at said exhaust output. In this manner, maximum combustion efficiency as well as maximum reduction efficiency are achieved.

A particular example of this method may be understood by referring again to FIG. 2. Let us assume that the amount of air entering into the boiler 10 through the primary air 20 is at the level denoted by point 42. The amount of sulphur dioxide is measured (shown by point 44). The amount of carbon monoxide measured by the sensor 34 is shown as point 52. From FIG. 2 it is seen that the level of carbon monoxide detected by the sensor 34 (point 52) is greater than the target value of 50. Thus, the total amount of air entering into the boiler 10 must be increased. In one case, the amount of air entering into the boiler 10 through the primary air input 20 is initially increased. The air entering through the primary air input 20 is increased until the carbon monoxide is at the target value 50 or the amount of sulphur dioxide measured is at a minimum, whichever occurs first. In the event the amount of carbon monoxide measured reaches the target value 50, but the sulphur dioxide level is not at a minimum, then air entering through the primary air input 20 is changed, however, with the total amount of air entering into the boiler 10 held at a constant. This may be done, for example, by decreasing the amount of air entering into the boiler 10 through the secondary air input 24 or the tertiary air input 26. In the event the amount of sulphur dioxide measured is at a minimum, but the carbon monoxide level is not yet at the target value 50, then the amount of air entering through the primary air input 20 is held at a constant while the total amount of air entering into the boiler 10 is increased. This may be accomplished by increasing the amount of air through the secondary air input 24 or the tertiary air input 26.

Conversely, if the measurement of the amount of carbon monoxide detected by sensor 34 is less than the target value 50, then the total amount of air entering into the boiler 10 must be decreased. This may be done, for example, by initially decreasing the amount of air entering into the boiler 10 through the primary air input 20. The effect of decreasing air through the primary air input 20 on the amount of sulphur dioxide measured at the exhaust 32 is analyzed, as before. In the event the amount of air entering through the primary air input 20 must be decreased to obtain a minimum measured value of sulphur dioxide, then the air is decreased further. On the other hand, if the amount of air entering through the primary air input 20 must be increased to obtain a minimum measured value of sulphur dioxide, then the amount of air through the primary air input 20 is increased until the value of sulphur dioxide measured is at a minimum value. Simultaneously, the total amount of air entering into the boiler 10 is decreased (for example, by decreasing the amount of air through the secondary air input 24 and the tertiary air input 26), to bring the level of carbon monoxide detected up to the target value.

The essence of the above described method is that the method of maximizing reduction efficiency in a recovery boiler may be a part of the larger scheme of maximizing the combustion efficiency of the boiler as well.

The apparatus to accomplish the foregoing methods may be by any means. For example, the output of the sensor 34 to measure the amount of sulphur dioxide and carbon monoxide at the exhaust output 32 may be an electrical signal tied to a digital computer 54, which in turn controls the fans (not shown) that regulate the amount of air entering into the boiler 10 through the air inputs 20, 24 and 26.

The theoretical basis for the method of present invention is as follows: As previously stated, the combustion of black liquor in a recovery boiler results in the following main chemical reaction:

$$2C+Na_2SO_4 \rightarrow 2CO_2+Na_2S \quad (1)$$

The definition of the efficiency of this conversion is as follows:

$$[Na_2S]/([Na_2S]+[Na_2SO_4])\times 100\% \quad (2)$$

where if all $Na_2SO_4$ molecules were converted to $Na_2S$ then this ratio becomes 100%. During the combustion process, however, due to the high temperature of the boiler 10, a part of $Na_2SO_4$ may be gassified releasing S to form $SO_2$. Equation (1), to take into account this loss, must now be expressed as:

$$xO_2+yC+ZNa_2SO_4 \rightarrow ACO_2+BNa_2S+CSO_2$$

with x, y, z, and A, B, C appropriately chosen to balance the equation.

Applicant's invention should now be clear as that of an indirect measurement and control of the efficiency of conversion. By minimizing the loss of S through $SO_2$, the applicants believe that maximization of the conversion of $Na_2SO_4$to $Na_2S$ will occur. Indeed, experimental results bear this out. Thus, this invention is an indirect method of maximizing reduction efficiency through minimization of loss.

What is claimed is:

1. In a recovery boiler having a plurality of air inputs, with the primary input closest to the bed of said boiler, a fuel input, a smelt output, and an exhaust output, a method of controlling the combustion of fuel in said boiler to operate at the maximum reduction efficiency, said method comprising:

measuring the amount of sulphur dioxide at said exhaust output; and varying the amount of air entering into said boiler through the primary air input until the minimum amount of sulphur dioxide is measured at said exhaust output.

2. The method of claim 1 wherein said varying step comprises:

increasing the amount of air entering through the primary air input;

noting the amount of sulphur dioxide at said exhaust; and changing the amount of air entering through the primary air input in response to the amount of sulphur dioxide noted and the amount of sulphur dioxide measured.

3. The method of claim 2 wherein said changing step is:

increasing the amount of air entering through the primary air input in the event the amount of sulphur dioxide noted is less than the amount of sulphur dioxide measured.

4. The method of claim 2 wherein said changing step is:

decreasing the amount of air entering through the primary air input in the event the amount of sulphur dioxide noted is greater than the amount of sulphur dioxide measured.

5. The method of claim 1 wherein said varying step comprises:

decreasing the amount of air entering through the primary air input;

noting the amount of sulphur dioxide at said exhaust; and changing the amount of air entering through the primary air input in response to the amount of sulphur dioxide noted and the amount of sulphur dioxide measured.

6. The method of claim 5 wherein said changing step is:

increasing the amount of air entering through the primary air input in the event the amount of sulphur dioxide noted is greater than the amount of sulphur dioxide measured.

7. The method of claim 6 wherein said changing step is:

decreasing the amount of air entering through the primary air input in the event the amount of sulphur dioxide noted is less than the amount of sulphur dioxide measured.

8. In a recovery boiler having a plurality of air inputs, with the primary air input closest to the bed of said boiler, a fuel input, a smelt output, and an exhaust output, and a target value of carbon monoxide representing the maximum combustion efficiency of said boiler, a method of controlling the combustion of fuel in said boiler to operate at the maximum combustion and at the maximum reduction efficiency, said method comprising:

detecting the amount of carbon monoxide at said exhaust output;

changing the total amount of air entering into said boiler until the amount of carbon monoxide detected is equal to said target value;

measuring the amount of sulphur dioxide at said exhaust output;

varying the amount of air entering into said boiler through the primary air input but keeping the total amount of air entering into said boiler at a constant until the minimum amount of sulphur dioxide is measured at said exhaust output.

9. The method of claim 8, wherein said changing step is to initially increase the air entering into the boiler through the primary air input in the event the amount of carbon monoxide detected is greater than said target value.

10. The method of claim 8, wherein said changing step is to initially decrease the air entering to the boiler through the primary air input in the event the amount of carbon monoxide detected is less than said target value.

11. In a recovery boiler having a plurality of air inputs, with the primary air input closest to the bed of said boiler, a fuel input, a smelt output, an an exhaust output, and a target value of carbon monoxide representing the maximum combustion efficiency of said boiler, a method of controlling the combustion of fuel in said boiler to operate at the maximum combustion efficiency and at the maximum reduction efficiency, said method comprising:

detecting the amount of carbon monoxide at said exhaust output;

controlling the amount of air entering into said boiler through at least one of the air inputs other than the primary air input to maintain the amount of detected carbon monoxide equal to said target value;

measuring the amount of sulphur dioxide at said exhaust output;

controlling the amount of air entering into said boiler through the primary air input to maintain the minimum amount of sulphur dioxide measured at said exhaust output.

12. In a recovery boiler having a plurality of air inputs, with the primary air input closest to the bed of said boiler, a fuel input, a smelt output, and an exhaust output, a system for controlling the boiler to operate at the maximum reduction efficiency, said system comprising:

means to measure the amount of sulphur dioxide at said exhaust output; and control means coupled to receive signals from said measuring means and to control the amount of air entering into said boiler through the primary air input so that the minimum amount of sulphur dioxide is measured at said exhaust output.

* * * * *